US009947499B2

(12) United States Patent
Lin et al.

(10) Patent No.: US 9,947,499 B2
(45) Date of Patent: Apr. 17, 2018

(54) ULTRA LOW PROFILE ROCKER DESIGN

(75) Inventors: Jianzhuan Lin, West Hartford, CT (US); Trevor Fitch, Stuart, FL (US); Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 325 days.

(21) Appl. No.: 13/344,342

(22) Filed: Jan. 5, 2012

(65) Prior Publication Data

US 2012/0168295 A1 Jul. 5, 2012

Related U.S. Application Data

(60) Provisional application No. 61/430,075, filed on Jan. 5, 2011.

(51) Int. Cl.

| | |
|---|---|
| ***H01H 71/54*** | (2006.01) |
| ***H01H 23/16*** | (2006.01) |
| ***H01H 73/52*** | (2006.01) |
| *H01H 23/02* | (2006.01) |

(52) U.S. Cl.

CPC ..... *H01H 71/54* (2013.01); *H01H 23/162* (2013.01); *H01H 73/52* (2013.01); *H01H 23/02* (2013.01)

(58) Field of Classification Search

CPC ..... H01H 23/162; H01H 23/02; H01H 23/14; H01H 23/12; H01H 2221/016; H01H 71/1009; H01H 71/54; H01H 73/26; H01H 73/40; H01H 73/52

See application file for complete search history.

(56) References Cited

U.S. PATENT DOCUMENTS

| | | | | |
|---|---|---|---|---|
| 3,239,621 | A * | 3/1966 | Baulier et al. | 200/401 |
| 3,680,014 | A | 7/1972 | Wilkinson | |
| 4,158,119 | A * | 6/1979 | Krakik | 200/240 |
| 4,399,420 | A | 8/1983 | Palmer et al. | |
| 4,623,861 | A | 11/1986 | Krasij et al. | |
| 4,900,275 | A | 2/1990 | Fasano | |
| 5,486,660 | A * | 1/1996 | Fasano | 200/401 |
| 6,008,459 | A * | 12/1999 | Faber et al. | 200/401 |

(Continued)

FOREIGN PATENT DOCUMENTS

| | | |
|---|---|---|
| CN | 1913074 A | 2/2007 |
| JP | S5811842 U | 1/1983 |

OTHER PUBLICATIONS

International Search Report and Written Opinion of the International Searching Authority; Application No. PCT/US2012/020303; dated Apr. 25, 2012; dated May 3, 2012; 7 pages.

*Primary Examiner* — Felix O Figueroa
(74) *Attorney, Agent, or Firm* — Forge IP, PLLC

(57) ABSTRACT

A rocker switch having a housing and a rocker extending from the housing. The rocker has a first side with a first end and a second end, a second side adjacent to the first side, and a channel. The channel is disposed on the second side of the rocker and has a first end and a second end. A pivot point is disposed on a crank. A pin, disposed on the crank, is located in a first side of the channel. The depression of the first end of the rocker causes a rotational movement of the channel in a curvilinear path around the pivot point, causing a rotational movement of the crank, moving the pin from the first end of the channel toward the second end of the channel.

23 Claims, 9 Drawing Sheets

(56) References Cited

U.S. PATENT DOCUMENTS

| | | | |
|---|---|---|---|
| 6,400,242 | B1 | 6/2002 | Fasano et al. |
| 6,414,575 | B1 | 7/2002 | Swift |
| 6,422,658 | B1 | 7/2002 | Valeriano |
| 6,444,930 | B1 | 9/2002 | MacDonald et al. |
| 6,489,724 | B1 | 12/2002 | Smith et al. |
| 6,498,310 | B1 | 12/2002 | Bugryn |
| 6,531,938 | B1 | 3/2003 | Smith et al. |
| 6,541,719 | B1 | 4/2003 | Powell |
| 6,713,693 | B1 | 3/2004 | Sadowski et al. |
| 6,809,282 | B2 | 10/2004 | Fasano |
| 6,826,457 | B2 | 11/2004 | Henson et al. |
| 6,861,594 | B2 | 3/2005 | Sadowski et al. |
| 6,884,955 | B1 | 4/2005 | Yu |
| 7,012,795 | B2 | 3/2006 | Fasano et al. |
| 7,170,021 | B2 | 1/2007 | Sorenson |
| 7,495,189 | B2 | 2/2009 | Christmann et al. |
| 2004/0145846 | A1 | 7/2004 | Fasano et al. |
| 2004/0149557 | A1 | 8/2004 | Sadowski et al. |
| 2006/0266587 | A1 | 11/2006 | Sorenson |
| 2007/0034495 | A1 | 2/2007 | Christmann et al. |
| 2008/0100140 | A1 | 5/2008 | Sorenson et al. |
| 2008/0247100 | A1 | 10/2008 | Fasano |

* cited by examiner

ULTRA LOW PROFILE ROCKER DESIGN

CROSS-REFERENCE TO RELATED APPLICATIONS

The present application claims the benefit under 35 U.S.C. § 119(e) of U.S. Provisional Patent Application Ser. No. 61/430,075, filed on Jan. 5, 2011, the content of which is incorporated herein by reference.

FIELD OF THE INVENTION

The present invention relates generally to a rocker switch, and, more specifically, relates to a rocker switch with a low profile.

BACKGROUND OF THE INVENTION

A rocker switch provides a discrete on/off switch that allows a user to easily determine if the switch is active or not. In an off position, a rocker switch prevents any flow of electricity, or the flow of an electric signal. When the user of the switch activates the rocker switch, a connection is made allowing for the flow of electricity, or of an electric signal. Rocker switches have many applications; common applications include light switches, general power switches, and switches in circuit breakers.

During operation of a rocker switch, any activation, or deactivation of the switch, by moving the rocker, causes a mechanical movement inside of the housing. When the user activates the switch, the portion of the switch (the rocker) that is outside of the housing is moved. The rocker is connected to a pin, which causes a subsequent movement inside of the housing, either completing or disconnecting a circuit (activating or deactivating the switch).

Rocker switches are used in a variety of applications; however, the specific placement of a rocker switch depends greatly on the overall size of the switch housing, and the size of the portion of the switch that is external to the housing. The size of the housing of the rocker switch limits the placement of the switch, as the housing needs sufficient space to be perpendicularly inserted into the device. Additionally, a switch mechanism that requires a large switch housing may also require a larger portion of the switch to be external to the housing. This creates two problems for the manufacturers of devices that use the switch. First, a larger external portion makes it easier for the switch to be accidentally activated or deactivated. This is especially an issue where the user's hand is regularly near the switch, such as when the switch is used in a circuit breaker near other switches. A large external portion is cumbersome, and may cause the person interacting with the circuit breaker to accidentally activate or deactivate a switch. This presents a significant problem as the user may accidentally activate a switch that controls the flow of electricity where another individual may be working, or accidentally deactivate a switch that controls the flow of electricity to a critical component.

The second problem with a switch with a large external portion is that it is not aesthetically pleasing. This limits the use to devices that do not rely on aesthetics when designing the device. Such a limitation prohibits the use of rocker switches in a large number of devices.

Prior art rocker switches, such as the switch 900 in FIG. 9, are complicated, and relatively costly to manufacture. The housing is bulky, requiring a minimum of three separate components to form the housing around the internal components of the switch, and the rocker switch requires a large rocker to function. The housing requires a top portion 960 to create a pivot point for the rocker (this top portion is eliminated by the present invention). To mechanically open or close the circuit, the rocker contains a channel 920 allowing free movement of a pin 915 within the channel. A pin 915 is held inside of the channel 920, which extends from the middle of the rocker. The depression of the rocker causes the pin 915 to move in an inverse arc direction with respect to the pivot point of the crank, and slide within channel 920, which is always oriented radially relative to the pivot point of the rocker 965. The inverse arc movement of the pin 915 causes a lateral movement in the crank, which opens or closes the circuit. Because the pin 915 is only capable of moving in an inverse arc with respect to the pivot point of the crank, and the channel 920 of the switch must be located directly beneath the rocker and is always radial with respect to the pivot point of the rocker 965, the external portion of the switch needs to be large enough to accommodate this placement, and the limited movement of the pin 915. Additionally, as the pin 915 only moves in an inverse arc motion with respect to the pivot point of the crank, the housing needs to be substantially large as the connection between the pin 915 to the crank requires a large space to translate the inverse arc motion of the pin 915 in one direction to a lateral motion of the crank in a substantially perpendicular direction. Finally, as the depression of the switch causes the inverse arc movement of the pin 915, the open position of the switch requires the external portion of the switch to be on the opposite side as that of the pin 915 so that when the external portion is depressed, the circular movement of the external portion, housed inside of the housing, causes a forward (arc) movement of the pin 915.

What is desired, therefore, is a rocker switch with a mechanism that allows for a substantial reduction in size, eliminates components, and is less expensive to manufacture as compared to prior art rocker switches.

SUMMARY OF THE INVENTION

The invention is directed to a low profile rocker switch for use as a general on/off switch, in a circuit breaker, or in various other applications. The design allows for substantially reduced spatial requirements of the switch housing, and a reduction of the number of components required for the rocker switch.

These and other objects of the present invention are achieved by provision of a rocker switch having a housing and a rocker extending from the housing. The rocker has a first side with a first end and a second end, a second side adjacent to the first side, and a channel. The channel is disposed on the second side of the rocker and has a first end and a second end. A pivot point is disposed on a crank. A pin, disposed on the crank, is located in a first side of the channel. The depression of the first end of the rocker causes a rotational movement of the channel in a curvilinear path around the pivot point, causing a rotational movement of the crank, moving the pin from the first end of the channel toward the second end of the channel.

In some of these embodiments, the first end of the rocker is substantially flat. In some of these embodiments, the first end of the rocker has a lip. In certain of these embodiments, the second side of the rocker is substantially curved. In certain of these embodiments, the channel is shaped as a rectangle with curved ends. In some of these embodiments, the housing includes electrical components for use in a circuit breaker. In some of these embodiments, the first end of the first side of the rocker is located on the same side of the switch as the pin. In certain of these embodiments, the rotational movement of the pin causes a lateral movement of the electrical components completing a circuit. In certain of these embodiments, the depression of the second end of the first side of the rocker causes a rotational movement of said crank in an opposite direction, moving said pin from said second end of said channel toward said first end of said channel. In certain of these embodiments, the channel is angled parallel to the first side of the rocker. In certain of these embodiments, the curvilinear path of the channel around the pivot point has a varying radius.

In another embodiment of the present invention is a rocker switch having a housing and a rocker extending from the housing. The rocker has a first side with a first end and a second end, a second side adjacent to the first side, and a channel. The channel is disposed on the second side of the rocker and has a first end and a second end. A pivot point is disposed on a crank. A pin, disposed on the crank, is located in a first side of the channel. The depression of the first end of the rocker causes a rotational movement of the channel through a plane parallel to a top surface of the housing which intersects the pivot point, causing a rotational movement of the crank, moving the pin from the first end of the channel toward the second end of the channel.

In some of these embodiments, the first end of the rocker is substantially flat. In some of these embodiments, the first end of the rocker has a lip. In certain of these embodiments, the second side of the rocker is substantially curved. In certain of these embodiments, the channel is shaped as a rectangle with curved ends. In some of these embodiments, the housing includes electrical components for use in a circuit breaker. In some of these embodiments, the first end of the first side of the rocker is located on the same side of the switch as the pin. In certain of these embodiments, the rotational movement of the pin causes a lateral movement of the electrical components completing a circuit. In certain of these embodiments, the depression of the second end of the first side of the rocker causes a rotational movement of said crank in an opposite direction, moving said pin from said second end of said channel toward said first end of said channel. In certain of these embodiments, the channel is angled parallel to the first side of the rocker.

The inventions and its particular features and advantages will become more apparent from the following detailed description considered with reference to the accompanying drawings.

DETAILED DESCRIPTION OF THE INVENTION

Figure 1:
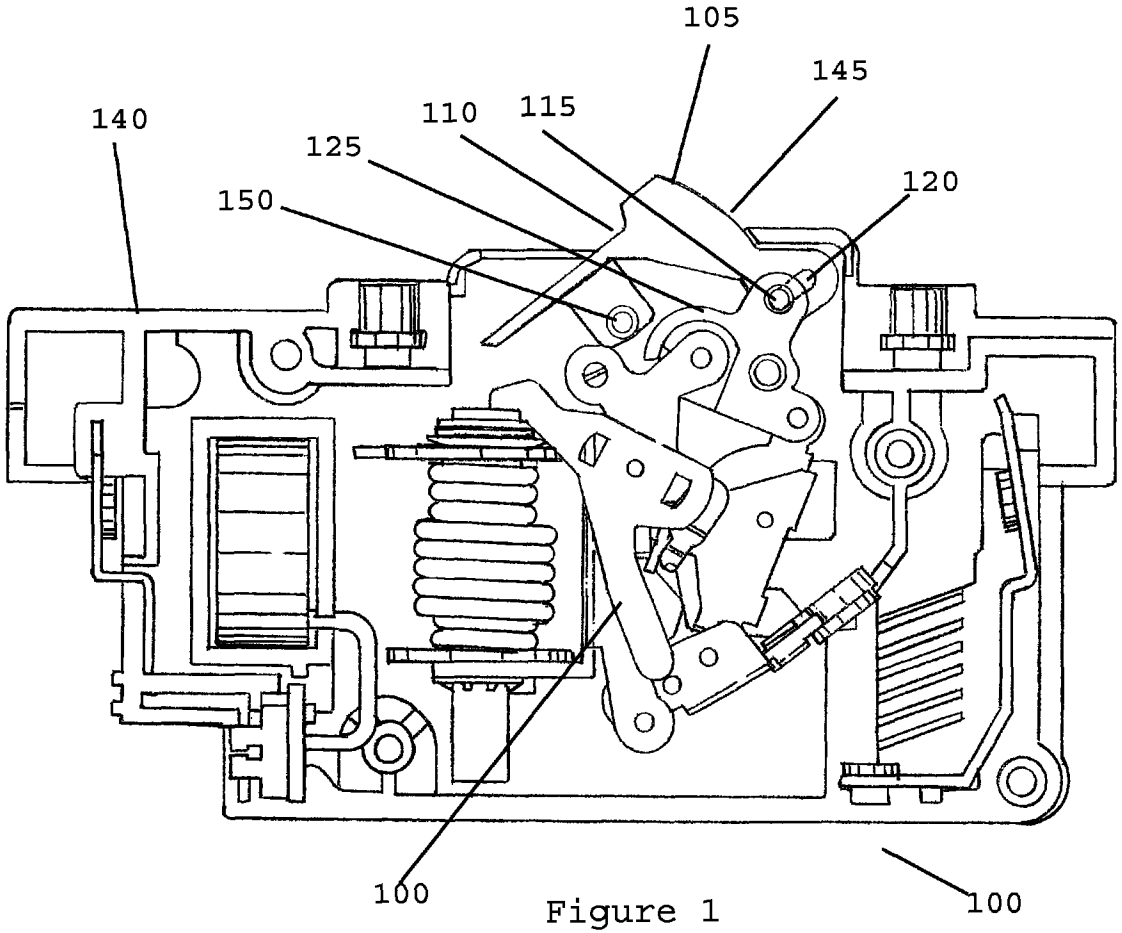
FIG. 1 is side view of a rocker switch in the open position according to the present invention.

The exemplary embodiments of the present invention may be further understood with reference to the following description and the related appended drawings, wherein like elements are provided with the same reference numerals. The exemplary embodiments of the present invention are related to a rocker switch. Specifically, the rocker switch allows for a substantially reduced profile and a substantially reduced depth. The exemplary embodiments are described with reference to single pole rocker switch for use in a circuit breaker, but those skilled in the art will understand that the present invention may be implemented in any rocker switch and is not limited to a single pole switch for use in a circuit breaker.

Figure 5:
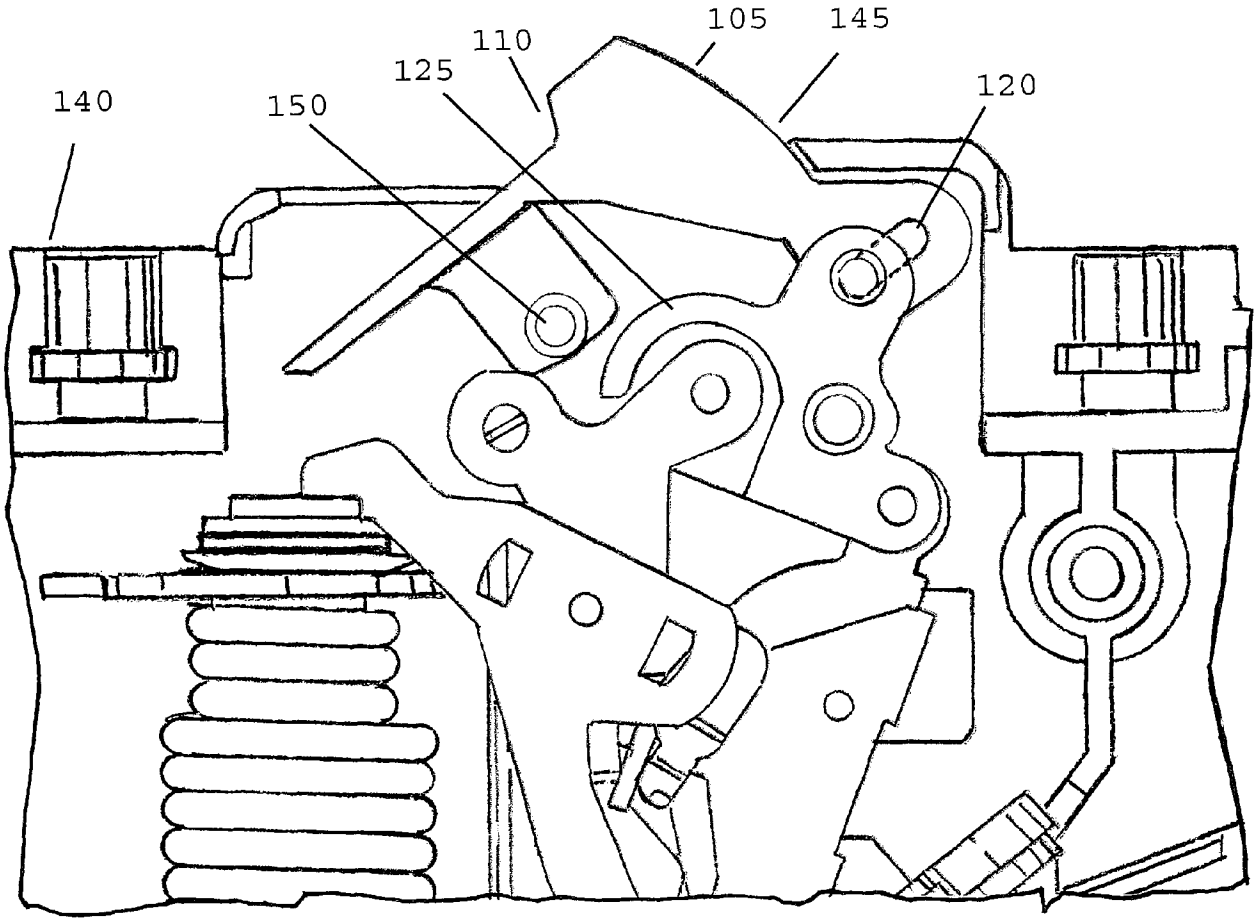
FIG. 5 is an enlarged side view of the rocker switch according to FIG. 1.

As best seen in FIGS. 1 and 5, side views of rocker switch 100, in an opened position, are shown. Rocker switch 100 may contain a rocker 105 extending from a housing 140. Housing 140 encloses the entirety of the mechanical and electrical components of rocker switch 100 except for a portion of rocker 105. Rocker 105 may have a substantially curved portion 145 to allow for easier entry into housing 140 when rocker 105 is depressed, however rocker 105 need not have a substantially curved portion 145, and the side of the rocker may be substantially flat depending on the design of the opening in the housing. Opposite curved portion 145 is lip 110. Lip 110 protrudes from rocker 105 to allow for easier activation of rocker 105. Rocker 105 is attached to a pivot point 150, which is located inside of housing 140. Pivot point 150 allows for the rotational movement of rocker 105. When the user swipes his/her finger across rocker 105, to close the rocker, the user is able to grab lip 110 with his/her finger (not shown), facilitating easier operation of rocker 105 to close rocker switch 100.

Rocker 105 includes a channel 120, which is located entirely inside of housing 140. Channel 120 may extend directly from rocker 105 or channel 120 may be a separate component attached to rocker 105. In a preferred embodiment, channel 120 is angled with respect to the top surface of housing 100, and parallel to the angle formed by rocker 105 with respect to housing 100. However, channel 120 may be designed to be parallel with the top surface of housing 100. Channel 120 is shaped as a rectangle with curved ends; however, channel 120 could be of any shape that facilitates pin movement as described below including have one or more open ends. Channel 120 defines an opening sized to be slightly larger than the diameter of pin 115 to allow free movement of pin 115 within channel 120. Pin 115 is attached to crank 125, and is sized to fit within the opening defined by channel 120. When rocker switch 100 is in the open position, with rocker 105 not being depressed, pin 115 is located toward a first end of channel 120.

Rocker 105 is operated by depressing the extended portion of rocker 105. In the exemplary embodiment, the extended portion of the rocker is on the same side of the rocker as pin 115; however, rocker 105 could be designed such that the extended portion is on the opposite side as that of pin 115. It should be noted, that prior art systems require the extended portion to be opposite of the pin so as to cause a lateral movement. The design of the present invention, explained in detail below, allows the extended portion to be on either side of rocker 105.

Figure 2:
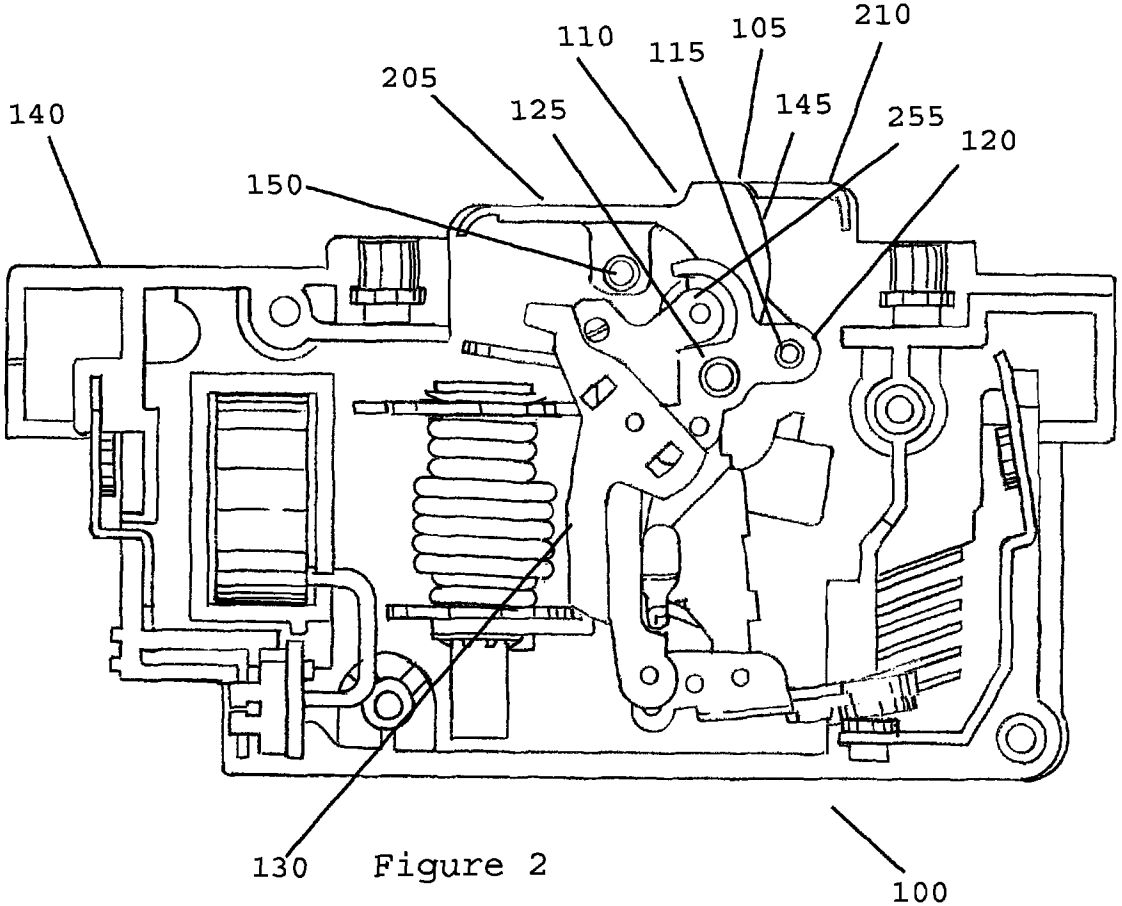
FIG. 2 is a side view of the rocker switch from FIG. 1 in the closed position.
Figure 3:
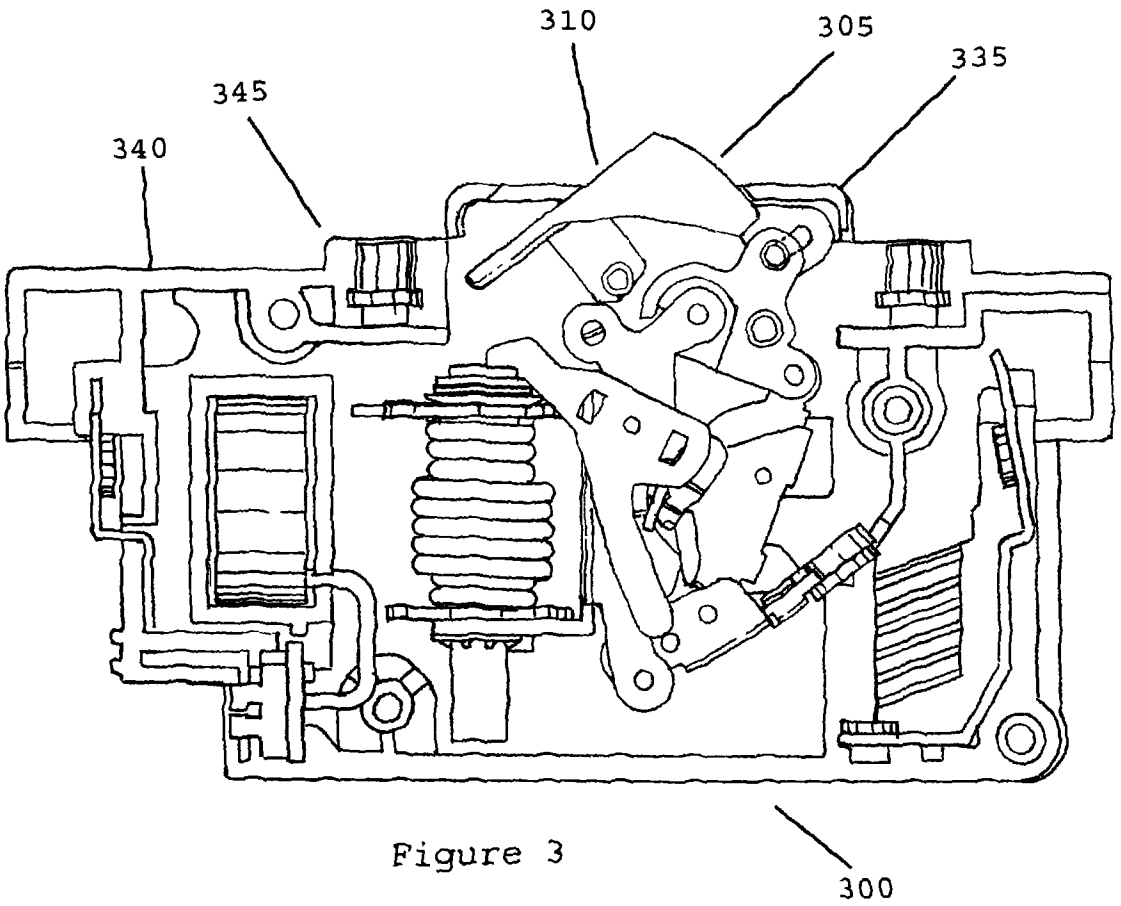
FIG. 3 is a side view of a rocker switch, in the open position, having substantially the same components to that of the rocker switch of FIG. 1.
Figure 4:
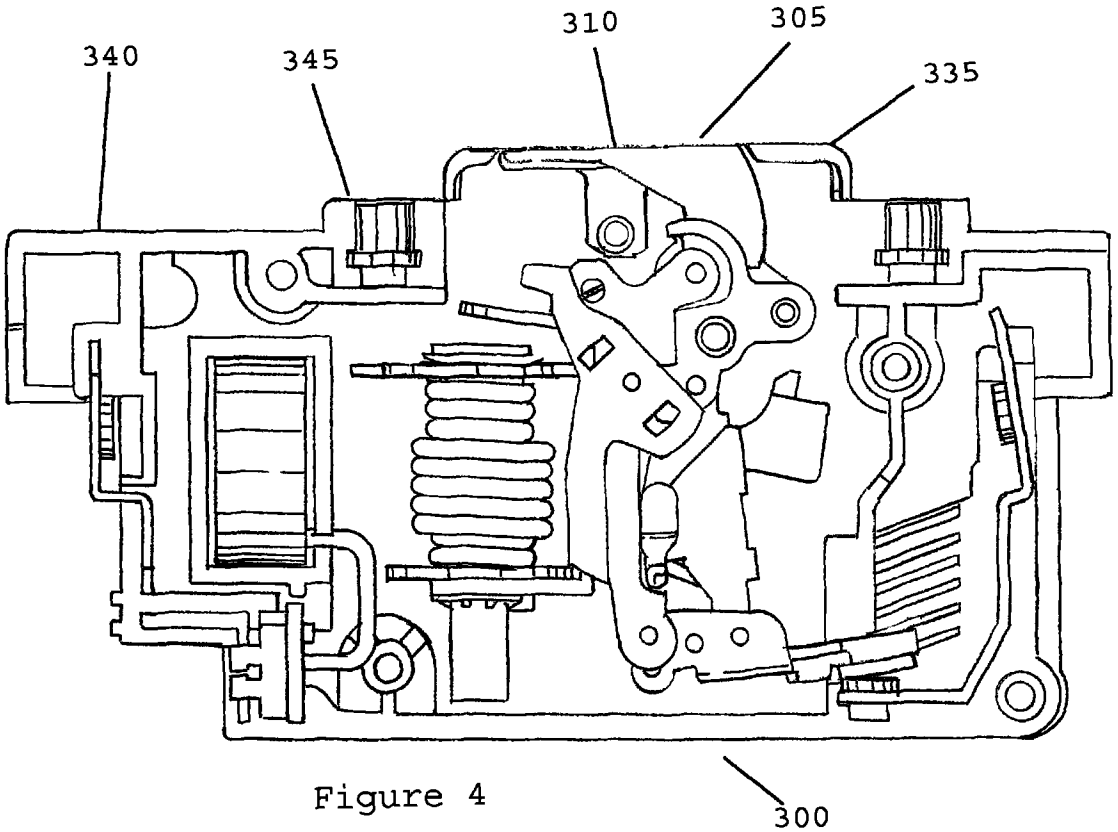
FIG. 4 is a side view of the rocker switch from FIG. 3 in the closed position.
Figure 6:
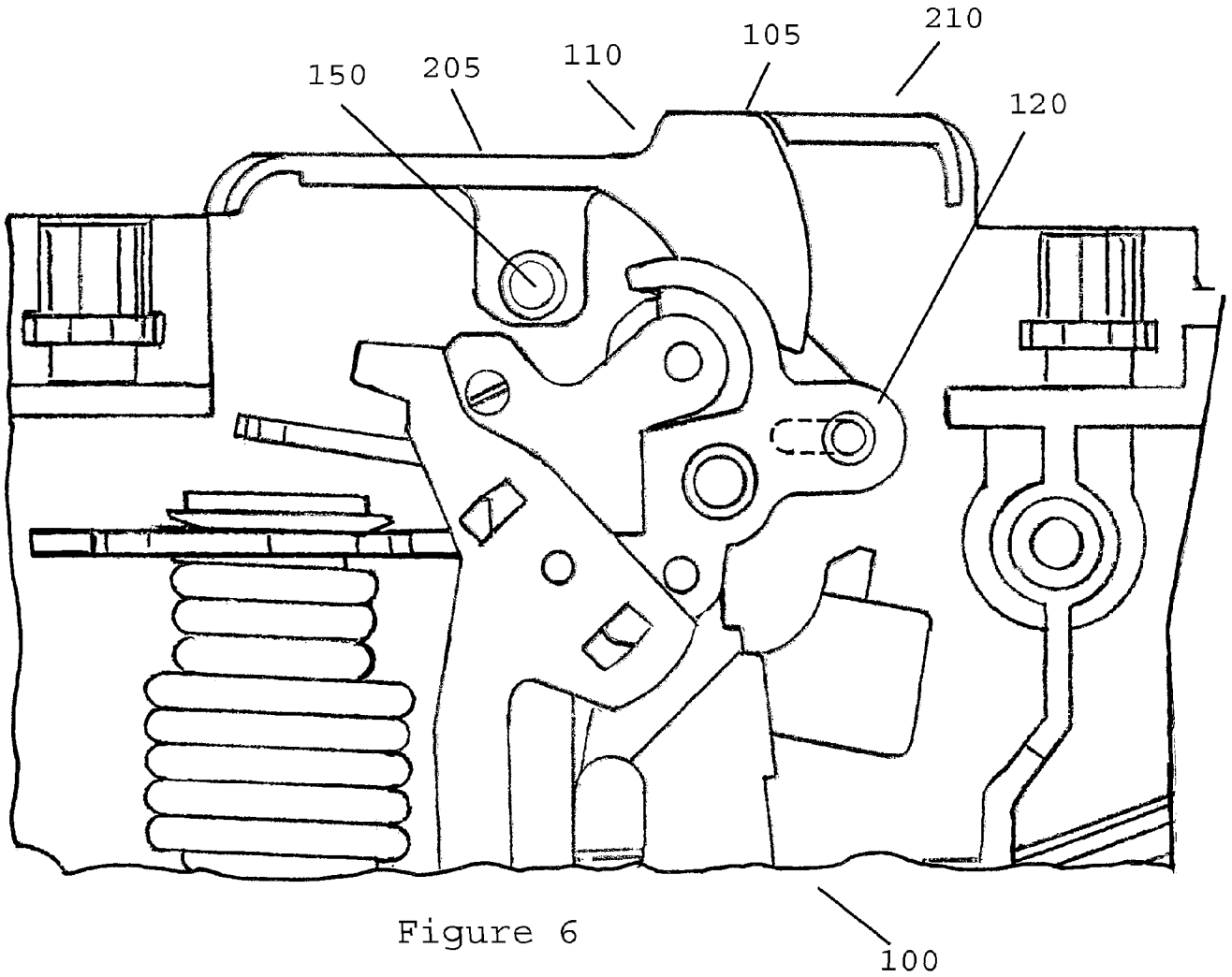
FIG. 6 is an enlarged side view of the rocker switch according to FIG. 2.
Figure 7:
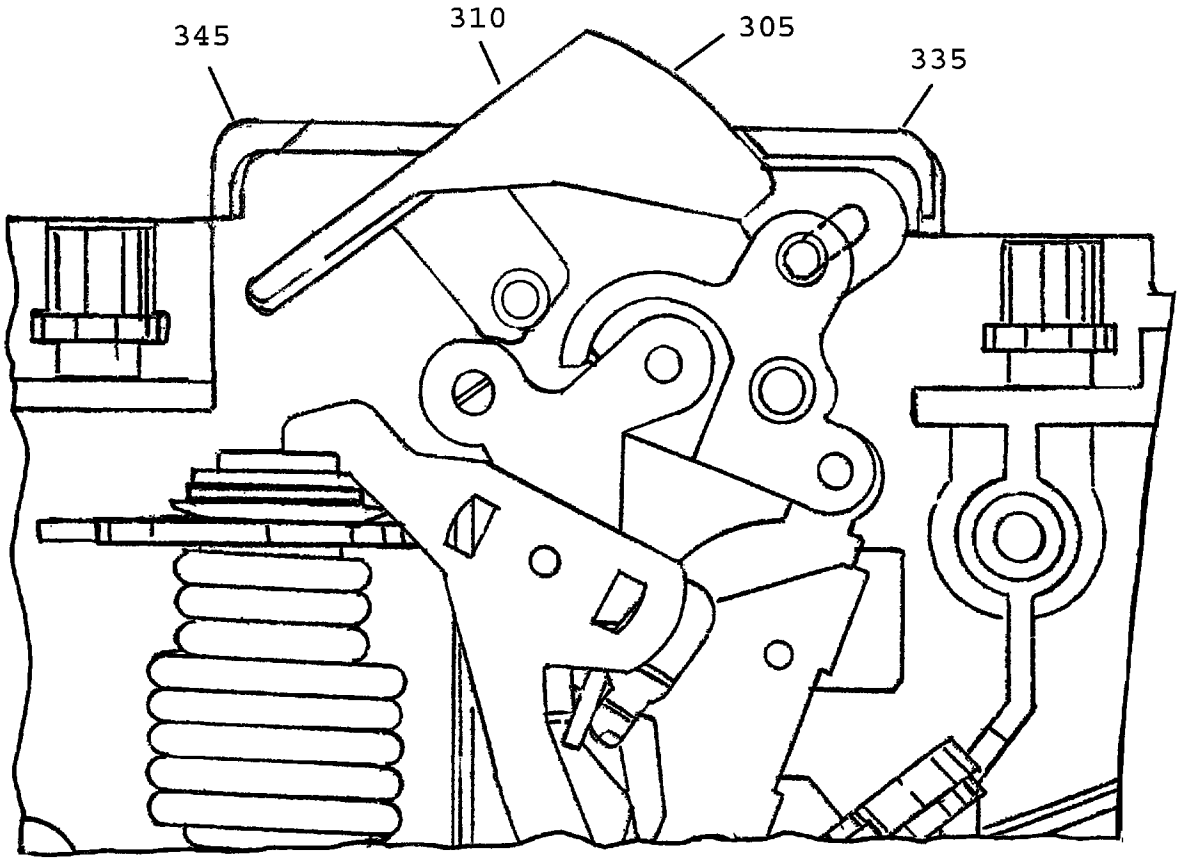
FIG. 7 is an enlarged side view of the rocker switch according to FIG. 3.
Figure 8:
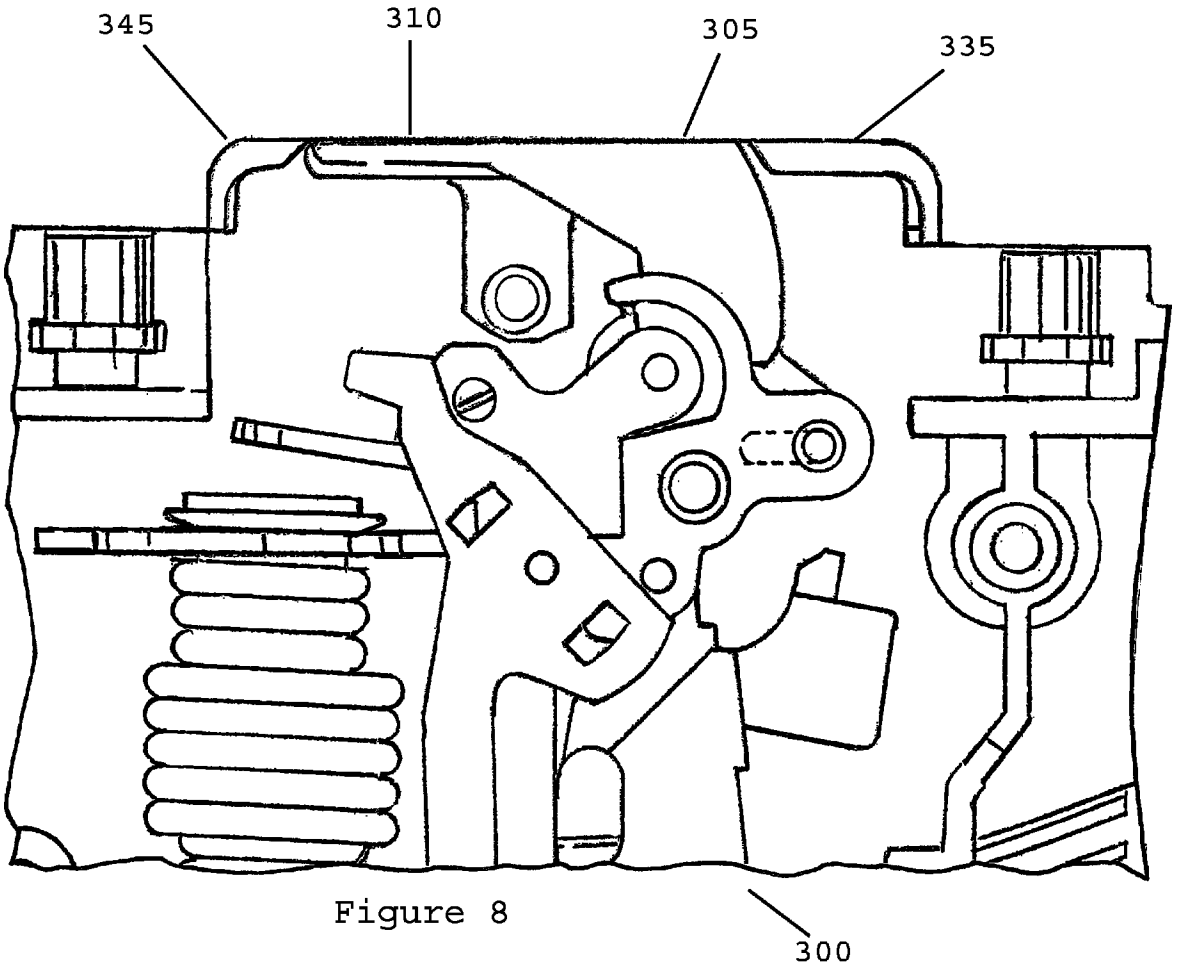
FIG. 8 is an enlarged side view of the rocker switch according to FIG. 4.
Figure 9:
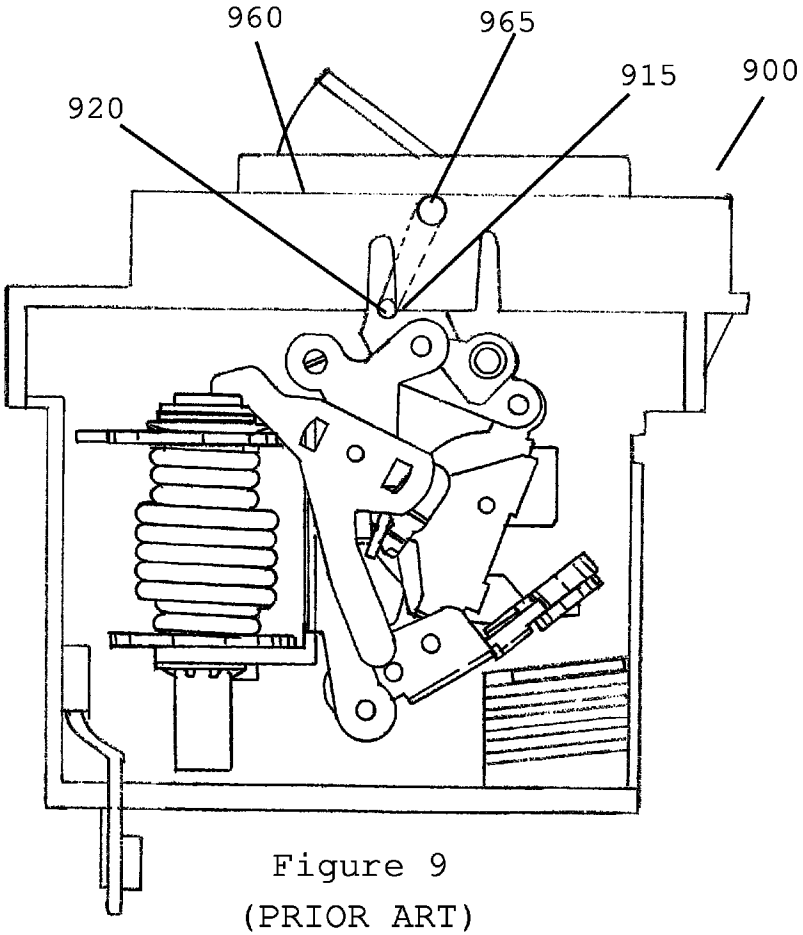
Figure 9 (PRIOR ART)
FIG. 9 is a side view of a rocker switch according to the prior art.

As best seen in FIGS. 2 and 6, side views of rocker switch 100, in a closed position, are shown. When rocker 105 is depressed, a rotational movement is caused by the connection of rocker 105 to pivot point 150. The rotational movement of rocker 105 causes channel 120 to be rotationally moved in a curvilinear path around pivot point 255 of crank 125. The rotational movement of channel 120 may additionally cause channel 120 to move through the plane that is parallel to the top surface of rocker switch 100, which intersects pivot point 255. The rotational movement of channel 120 forces a rotational movement of pin 115 from the first end of channel 120 toward a second end of channel 120. The rotational movement of channel 120, and pin 115, causes a lateral movement of the mechanical on/off components 130, inside of housing 140, thereby closing the circuit and activating the rocker switch 100. To deactivate rocker switch 100, end portion 205 is depressed. The depression of end portion 205 causes a rotational movement in the opposite direction to the movement created upon the initial depression of rocker 105. This causes a rotational movement of pin 115 back toward the first end of channel 120, deactivating rocker switch 100.

Housing 100 has a curvilinear portion 210 located near the substantially curved portion 145. Curvilinear portion 210 extends from housing 100 and is sized approximately the same height as that of lip 110. This allows switch 105, with lip 100, to create a flat surface with housing 100 through curvilinear portion 210.

As best seen in FIGS. 3, 4, 7 and 8, side views of rocker switch 300, having substantially the same components to that of rocker switch 100, are shown. Rocker switch 300 operates in a substantially similar manner to that of rocker switch 100. Rocker switch 300 contains a housing 340 that houses the mechanical and electrical components of rocker switch 300. Rocker switch 300 has an external rocker 310 which extends from housing 340. Similar to rocker 105 of rocker switch 100, rocker 305 has a substantially curved portion 345. However, rocker 305 does not have a lip and rocker 305 forms a substantially flat surface opposite to curved portion 345.

Housing 340 contains curvilinear portion 335 and curvilinear portion 345 located on opposite sides of rocker 305, however, since rocker 305 does not have a lip, the height of curvilinear portion 335 and 345 is less than the height of curvilinear portion 210 from FIG. 2. When rocker 305 is depressed, as there is no lip, rocker 105 forms a flat surface with curvilinear portions 335 and 345.

This rocker switch has the advantage in that it creates a substantially smaller profile, from the surface of the device it is installed on. Additionally, it has a substantially reduced depth inside of the device, allowing it to be placed in smaller devices, and more varied locations. Finally, the rocker eliminates a bulky component required by prior art rocker switches. The rocker is cheap to manufacture, and is easily integrated with existing electrical components.

It would be appreciated by those skilled in the art that various changes and modification can be made to the illustrated embodiments without departing from the spirit of the present invention. All such modifications and changes are intended to be covered hereby.

What is claimed is:

1. A rocker switch comprising:

a housing;

a rocker pivotably attached to said housing about a rocker pivot point, said rocker comprising:

a first side having a first end disposed on a first side of said rocker pivot point and a second end disposed on a second side of said rocker pivot point opposite to the first end, such that movement of the first end in one direction causes pivoting movement of the second end in an opposite direction about the rocker pivot point, a second side adjacent to said first side, and a channel, disposed on said second side of said rocker, said channel having a first end and a second end, a crank pivotably attached to said housing about a crank pivot point;

a pin disposed on said crank;

wherein, in an off position, said first end of said first side of said rocker extends from said housing, and said pin is located in a first end of said channel; and wherein a depression of said first end of said rocker to an on position causes said first end of said first side of said rocker to create a substantially flat surface with said housing such that said first end of said first side of said rocker no longer extends from said housing and also causes a rotational movement of said channel in a curvilinear path around said rocker pivot point and through a plane that passes through the crank pivot point and that is parallel to the substantially flat surface, causing a rotational movement of said crank about said crank pivot point, moving said pin from said first end of said channel toward said second end of said channel.

2. The rocker switch according to claim 1, wherein said first end of said first side of said rocker is substantially flat.

3. The rocker switch according to claim 1, wherein said first end of said first side of said rocker has a lip.

4. The rocker switch according to claim 1, wherein said second side of said rocker is substantially curved.

5. The rocker switch according to claim 1, wherein said channel is shaped as a rectangle with curved ends.

6. The rocker switch according to claim 1, further comprising electrical components for use in a circuit breaker.

7. The rocker switch according to claim 1, wherein said first end of said first side of said rocker is located on a same side of said rocker pivot point as said pin.

8. The rocker switch according to claim 6, wherein said rotational movement of said pin causes a lateral movement in said electrical components completing a circuit.

9. The rocker switch according to claim 1, wherein, when the rocker switch is in the on position, a depression of said second end of said first side of said rocker causes a rotational movement of said crank in an opposite direction, moving said pin from said second end of said channel toward said first end of said channel and causing said first end of said first side of said rocker to extend from said housing.

10. The rocker switch according to claim 1, wherein said channel is angled substantially parallel to said first side of said rocker.

11. The rocker switch according to claim 1, wherein said curvilinear path of said channel around said rocker pivot point has a varying radius.

12. A rocker switch comprising:

a housing;

a rocker pivotably attached to said housing about a rocker pivot point, said rocker comprising:

a first side having a first end disposed on a first side of said rocker pivot point and a second end disposed on a second side of said rocker pivot point opposite to the first end, such that movement of the first end in one direction causes pivoting movement of the second end in an opposite direction about the rocker pivot point, a second side adjacent to said first side, and a channel, disposed on said second side of said rocker, said channel having a first end and a second end, a crank pivotably attached to said housing about a crank pivot point;

a pin disposed on said crank;

wherein, in an off position, said first end of said first side of said rocker extends from a top surface of said housing, and said pin is located in a first end of said channel; and wherein a depression of said first end of said rocker to an on position causes said first end of said first side of said rocker to create a substantially flat surface with the top surface of said housing such that said first end of said first side of said rocker no longer extends from the top surface of said housing and also causes a rotational movement of said channel through a plane parallel to the top surface of said housing which intersects said crank pivot point, causing a rotational movement of said crank, moving said pin from said first end of said channel toward a second end of said channel.

13. The rocker switch according to claim 12, wherein said first end of said first side of said rocker is substantially flat.

14. The rocker switch according to claim 12, wherein said first end of said first side of said rocker has a lip.

15. The rocker switch according to claim 12, wherein said second side of said rocker is substantially curved.

16. The rocker switch according to claim 12, wherein said channel is shaped as a rectangle with curved ends.

17. The rocker switch according to claim 12, further comprising electrical components for use in a circuit breaker.

18. The rocker switch according to claim 12, wherein said first end of said first side of said rocker is located on a same side of said rocker pivot point as said pin.

19. The rocker switch according to claim 12, wherein said rotational movement of said pin causes a lateral movement in said electrical components completing a circuit.

20. The rocker switch according to claim 12, wherein, when the rocker switch is in the on position, a depression of said second end of said first side of said rocker causes a rotational movement of said crank in an opposite direction, moving said pin from said second end of said channel toward said first end of said channel and causing said first end of said first side of said rocker to extend from said housing.

21. The rocker switch according to claim 12, wherein said channel is angled substantially parallel to said first side of said rocker.

22. The rocker switch according to claim 1, wherein, when the rocker switch is in the on position, said second end of said first side of said rocker creates a substantially flat surface with said housing.

23. The rocker switch according to claim 12, wherein, when the rocker switch is in the on position, said second end of said first side of said rocker creates a substantially flat surface with said housing.

* * * * *